US011837427B2

(12) United States Patent
Arrighetti et al.

(10) Patent No.: US 11,837,427 B2
(45) Date of Patent: Dec. 5, 2023

(54) ARC CHAMBER FOR A LOW-VOLTAGE SWITCHING DEVICE

(71) Applicant: ABB S.p.A., Milan (IT)

(72) Inventors: Pierantonio Arrighetti, Bossico (IT); Antonello Antoniazzi, Milan (IT); Alessandro Adami, Bergamo (IT); Daniele Torresin, Birmenstorf (CH); Francesco Agostini, Zurich (CH)

(73) Assignee: ABB S.p.A., Milan (IT)

( * ) Notice: Subject to any disclaimer, the term of this patent is extended or adjusted under 35 U.S.C. 154(b) by 0 days.

(21) Appl. No.: 17/048,699

(22) PCT Filed: Apr. 19, 2018

(86) PCT No.: PCT/EP2018/060104

§ 371 (c)(1),
(2) Date: Oct. 19, 2020

(87) PCT Pub. No.: WO2019/201446

PCT Pub. Date: Oct. 24, 2019

(65) Prior Publication Data

US 2021/0241981 A1 Aug. 5, 2021

(51) Int. Cl.
*H01H 9/34* (2006.01)
*H01H 73/18* (2006.01)

(52) U.S. Cl.
CPC ..... *H01H 9/342* (2013.01); *H01H 73/18* (2013.01); *H01H 2009/347* (2013.01)

(58) Field of Classification Search
CPC ..... H01H 9/342; H01H 9/345; H01H 9/362; H01H 2009/347; H01H 73/18; H01H 71/0214
USPC ..... 218/150, 149, 151, 155–158, 34
See application file for complete search history.

(56) References Cited

U.S. PATENT DOCUMENTS 7,674,996 B2 * 3/2010 Shea ..... H01H 9/302 218/34
7,705,263 B2 * 4/2010 Rane ..... H01H 9/44 218/149
8,772,665 B2 * 7/2014 An ..... H01H 9/346 218/34

(Continued)

FOREIGN PATENT DOCUMENTS

CN 101908442 * 8/2010 ..... H01H 9/36
CN 102129924 A 7/2011

(Continued)

OTHER PUBLICATIONS

Translation FR 2655770 (original document published Jun. 14, 1991) (Year: 1991).*

(Continued)

*Primary Examiner* — William A Bolton
(74) *Attorney, Agent, or Firm* — Armstrong Teasdale LLP

(57) ABSTRACT

An arc chamber for a low voltage switching device including an insulating casing, having a first and a second lateral walls, a rear and a front wall, that defines an internal space housing a number or arc-breaking plates, a top wall of the casing having a discharge opening for venting off the gases from the internal space, the discharge opening being covered by a top cover. The arc chamber for a low voltage switching device includes a filter made of an open cell metal foam that is positioned at the discharge opening.

20 Claims, 9 Drawing Sheets

(56) References Cited

U.S. PATENT DOCUMENTS

| | | | | |
|---|---|---|---|---|
| 9,064,648 | B2 * | 6/2015 | Rival | H01H 9/342 |
| 9,412,543 | B2 * | 8/2016 | Lammers | H01H 9/302 |
| 2010/0170876 | A1 * | 7/2010 | Bach | H01H 9/342 218/157 |
| 2011/0259852 | A1 | 10/2011 | Rival et al. | |
| 2015/0136740 | A1 * | 5/2015 | Afshari | H01H 33/08 218/149 |
| 2015/0270075 | A1 * | 9/2015 | Das | H01H 9/342 218/149 |
| 2017/0278653 | A1 * | 9/2017 | Rival | B01D 46/0032 |

FOREIGN PATENT DOCUMENTS

| | | | | |
|---|---|---|---|---|
| CN | 105803239 | A | 7/2016 | |
| EP | 2655770 | * | 6/1991 | H01H 9/342 |
| WO | 2008151936 | A2 | 12/2008 | |
| WO | 2008151936 | A3 | 12/2008 | |

OTHER PUBLICATIONS

Translation of CN101908442 (Original document published Aug. 12, 2010) (Year: 2010).*

European Patent Office, International Search Report & Written Opinion issued in corresponding Application No. PCT/EP2018/060104, dated Jan. 7, 2019.

* cited by examiner

ARC CHAMBER FOR A LOW-VOLTAGE SWITCHING DEVICE

The present invention relates to an arc chamber for a switching device, in particular a circuit breaker, a disconnector, or a contactor, with a high interruption power, to be used preferably in low-voltage electrical systems. The invention likewise relates to a switching device comprising said arc chamber.

It is known that switching devices, such as for example circuit breakers, disconnectors, contactors, limiters, hereinafter referred to as switches, for reasons of brevity, generally comprise a casing and one or more electrical poles, associated to each of which there is at least one pair of contacts that can be coupled to and uncoupled from one another. Switches of the known art also comprise control means that cause relative movement of said pairs of contacts so that they can assume at least one first, coupling, position (circuit closed) and one second, separation, position (circuit open).

As known, during the useful life of a low voltage switch, phenomena which expose the switch and the network to particularly heavy stresses can occur. This happens in the first place when the switch is required to withstand, even for short periods, currents greater than the rated values.

Thus, in general, in low voltage switches, the critical function of interrupting the current (whether nominal, overload or short-circuit current) is provided by the switch in a specific portion of said switch which is constituted by the so-called deionizing arc chamber.

Generally associated to each pole of the switch there is therefore at least one arc chamber, i.e., a region of space which is particularly suited to fostering electric-arc interruption. Arc chambers can be simple regions provided in the casing of the switch, or else can comprise various modular elements shaped, for example, like casings made of insulating material equipped with arc-breaking plates. Modular arc chambers, which are more advanced, present the advantage of being easily replaceable; moreover they can also be manufactured using materials that are more suitable as compared, for example, to the ones used for the casing of the switch.

Under operating conditions, as a consequence of the opening movement, the voltage between the contacts causes the dielectric discharge of the air, leading to the formation of the electric arc in the chamber. The arc is propelled by electromagnetic and fluid-dynamics effects inside a series of arc-breaking metal plates arranged in the chamber, which are meant to extinguish said arc by cooling and splitting actions.

During arc formation, the energy released by Joule effect is very high and causes thermal and mechanical stresses inside the plate containment region. In order to withstand these stresses, the design of the arc chamber must be evaluated carefully so as to obtain a component which is solid enough to withstand the thermal and mechanical stresses.

It is worth noting that, depending on the kind of switch and the arching phenomenon that takes place, the pressure in the contact zone, and in particular in the arc chamber, can reach very high values, e.g. as high as 30-40 bars, while the temperature of the ionized gases can reach values of 3000-4000° K.

It is therefore necessary that the arc chamber is provided with an adequate system for venting off and cooling the hot gases that develop during arching. To this purpose, the existing arc chambers for low voltage switching devices are generally provided with openings for the discharge of the hot gases produced during arching and with a filtering system which, among others, has the functions of cooling the gas, reducing the velocity of the flow at the discharge, preventing the emission of flame and/or incandescent gases.

A typical example of known solutions is given in the attached FIG. 1. In such solution, an arc chamber 100 typically comprises an insulating casing 1, having two lateral walls 2, 3, and a rear and front wall 4, 5. The top portion of the casing 1 has an opening which is covered by a top cover 7 having a number of large discharge openings. Two plastic perforated sheets 8 interspaced by a plastic spacer 9 are interposed between the top cover 7 and the insulating casing 1. The overpressure generated inside the arc chamber 100 is discharged through the opening on the top thereof and the perforations in the two plastic sheets 8 are generally misaligned so as to maximize the tortuosity along the gas path.

Another example, much more complicated, of an industrial embodiment of an arc chamber venting system in a low voltage switch device is given in patent document US20110259852A1 which discloses a closing system for an arc chamber enabling the gases generated by an electric arc to be cooled and filtered, and enabling said gases to be removed in differentiated manner according to the importance of the fault and to the excess pressure thus generated.

A common problem of these, as well as others, prior art system is given by the relatively high number of component parts that makes their assembly complicated and time consuming. Moreover, the thermal capacity per unit volume of the existing system is not always optimal to guarantee a proper venting of the hot gases from the arc chamber without resorting to complicated and cumbersome solutions.

On the basis of the above considerations, there is a need to have available alternative technical solutions that will enable the limits and the problems set forth above to be overcome.

Hence, the present disclosure is aimed at providing an arc chamber for a low-voltage switching device, which allows overcoming at least some of the above-mentioned shortcomings.

In particular, the present invention is aimed at providing an arc chamber for a low-voltage switching device which is able to reduce the velocity of the gas flow at the discharge. Furthermore, the present invention is aimed at providing an arc chamber for a low-voltage switching device which is able to prevent the emission of flame and/or incandescent gases in the outside ambient.

Moreover, the present invention is aimed at providing an arc chamber for a low-voltage switching device which is able to reduce the intensity of the shock wave generated during interruption.

In addition, the present invention is aimed at providing an arc chamber for a low-voltage switching device which is able to limit the back pressure wave generated in the internal part of the arc chamber.

Furthermore, the present invention is aimed at providing an arc chamber for a low-voltage switching device which is able to withstand the high mechanical and thermal stresses generated when arching phenomena occur.

Furthermore, the present invention is aimed at providing an arc chamber for a low-voltage switching device in which the number of component parts is limited.

Also, the present invention is aimed at providing an arc chamber for a low-voltage switching device, that is reliable and relatively easy to produce at competitive costs.

Thus, the present invention relates to an arc chamber for a low voltage switching device comprising an insulating casing, having a first and a second lateral walls, a rear and a front wall, that defines an internal space housing a number of arc-breaking plates, a top wall of said casing having a discharge opening for venting off the gases from said internal space, said discharge opening being covered by a top cover. The arc chamber for a low-voltage switching device of the present invention characterized in that a filter made of an open cell metal foam is positioned at said discharge opening.

A low voltage switching device, e.g. a circuit breaker, a disconnector, or a contactor, comprising an arc chamber as disclosed herein are also part of the present invention.

As better explained in the following description, thanks to the particular structure of the arc chamber for a low-voltage switching device of the present invention, the above-mentioned problems can be avoided, or at least greatly reduced.

Indeed, thanks to the use of an open cell metal foam as manufacturing material for the filter the performances of the arc chamber can be greatly improved with respect to existing solution, reducing at the same time the number of component parts, thereby greatly simplifying the manufacturing process of the arc chamber.

Open cell metal foams, and in general metal foams, are a relatively new class of materials. They are generally characterized by low densities and by a set of physical, mechanical, thermal, electrical and acoustic properties that make them extremely interesting for application in the electromechanical field.

In the case of the present invention it has been found that the use of an open cell metal foam as manufacturing material for the filter brings about a number of unexpected advantages with respect to the existing conventional solutions.

Indeed, as better explained in the following description, in the most simple solutions it is sufficient to cover the discharge opening of the arc chamber substantially entirely with a layer of an open cell metal foam properly dimensioned to obtain an adequate effect in terms of cooling of the gas, reduction of the velocity of the flow at the discharge, preventing the emission of flame and/or incandescent gases from the camber to the external ambient.

This represent a relevant improvement with respect to the existing solution in which it is necessary to resort to much more complicated system having a significant number of component parts, with a consequent increase of the assembly time and costs.

Moreover, it has also been found that thanks to the higher thermal capacity per unit volume of the open cell metal foam with respect to more conventional materials, it is possible to reduce the dimensions of the filter or to have a much better cooling effect for a given filter dimension with respect to the filter of known type.

In general, it has been found that the use of that the use of an open cell metal foam as manufacturing material for the filter brings about an improvement of one or more of the following factors which are essential, or at least desirable, for an optimal functioning of a filtering system in an arc chamber of a low voltage switching device:

- Flow control;
- Acoustic control;
- Mechanical thermo-elastic dumping of induced vibrations;
- Fire protection;
- Increased mechanical stiffness at the discharge opening of the switching device.

Another important factor for a good functioning of an open cell metal foam as manufacturing material for the filter is given by the internal structure and porosity of the foam. In this regard, it has been found that better results are obtained when in the open cell metal foam the internal channel are randomly distributed so that the increased tortuosity of the path brings about an increase of the turbulence of the gas flow with better results in terms of pressure drop and cooling effects.

Also the porosity is an important factor since a higher porosity brings about a higher wetted surface, i.e. an increase of the internal surface of the filter available for thermal exchanging with the discharge gases.

In this regard, in a typical embodiment of the arc chamber for a low voltage switching device according to the present invention, the open cell metal foam used as a material for the filter has a porosity of greater than 70%. In a more preferred embodiment of the present invention, the porosity of the open cell metal foam is greater than 80%, and in an even more preferred embodiment the porosity is greater than 85%.

As for the material, it has been found that particular good results are obtained using Ni—Cr alloys as manufacturing materials of the open cell foams. However, the choice of the material depend on the design constrains (e.g., dimensions, pressure drop, expected temperatures, . . . ) and the above indicated alloys are indicated as an exemplary embodiment and not as a limiting feature.

Another important property to be taken into consideration, is the thermal conductivity of the open cell metal foam used for manufacturing the filter. It has been found that the thermal conductivity of the open cell metal foam should be relatively low so as to limit damages (e.g. melting) of the filter and to limit heat diffusion in the area immediately around the filter.

In this respect, in preferred embodiments of the arc chamber for a low voltage switching device according to the present invention, the open cell metal foam has a thermal conductivity of lower than 15 $W \cdot m^{-1} \cdot K^{-1}$. In a more preferred embodiment of the present invention, the thermal conductivity is more preferably lower than 12 $W \cdot m^{-1} \cdot K^{-1}$, and in an even more preferred embodiment the thermal conductivity is lower than 10 $W \cdot m^{-1} \cdot K^{-1}$.

From a mechanical standpoint, considering the mechanical loads and stresses to which the filter is subjected, a further important property to be taken into consideration is the tensile strength which should be sufficiently high to withstand such load and stresses.

Therefore, in preferred embodiments of the arc chamber for a low voltage switching device according to the present invention, the open cell metal foam has preferably a tensile strength of greater than 5 MPa. In a more preferred embodiment of the present invention, the tensile strength is more preferably greater than 10 MPa, and in an even more preferred embodiment the tensile strength is greater than 15 MPa.

One of the distinguishing feature of the present invention is given by the fact that—given the good balance of mechanical, thermal and flow control properties that the filter made of an open cell metal foam has—it is possible to manufacture the filter as a single piece, instead of resorting to a combination of a number of pieces (made of different materials and/or with different features and properties and/or having different purposes) to realize a filter with the desired complete set of properties as in prior art filters.

Then, for a practical standpoint, the filter can be implemented into the arc chamber according to a number of embodiments, depending on the needs and the design and functionality constrains.

In a first exemplary embodiment of the arc chamber for a low voltage switching device, according to the present invention, the filter made of an open cell metal foam can be interposed directly between said discharge opening and said top cover.

In a second exemplary embodiment of the arc chamber for a low voltage switching device, according to the present invention, other component parts can be present. For instance, the arc chamber may comprise a perforated sheets which is positioned between said filter made of an open cell metal foam and said discharge opening; then a spacer can be interposed between said perforated sheets and said filter made of an open cell metal foam and the top cover is superimposed onto said filter made of an open cell metal foam.

In a third exemplary embodiment of the arc chamber for a low voltage switching device, according to the present invention, the filter made of an open cell metal foam can be integrated into the structure of the top cover. For instance the filter made of an open cell metal foam can be inserted into said top cover, in particular in a suitable seat provided in the top cover. This solution can be used when the filter and the top cover are made of different materials.

Alternatively, when the filter and the top cover are made of different materials, in a fourth exemplary embodiment of the arc chamber for a low voltage switching device, according to the present invention, the filter made of an open cell metal foam can be integrally made within said top cover.

Then, in a fifth exemplary embodiment of the arc chamber for a low voltage switching device, according to the present invention, said top cover can be entirely made of said open cell metal foam. In practice, with such solution the filter and the top cover are one and the same component, with great advantages in terms of compactness, better mechanical stability, assembly easiness, manufacturing cost reduction.

As previously said, in a further aspect the present invention also relates to a low voltage switching device, including but not limited to, a circuit breaker, a disconnector, or a contactor, comprises an arc chamber as disclosed herein. The practical implementation of such switching device is very easy and does not require further explanation, since the integration of a filter as disclosed herein in the casing of the arc chambers of the existing switching devices is very easy and straightforward.

Further features and advantages of the present invention will be more clear from the description of preferred but not exclusive embodiments of the arc chamber for a low-voltage switching device of the present invention, shown by way of examples in the accompanying drawings, wherein.

Figure 1:
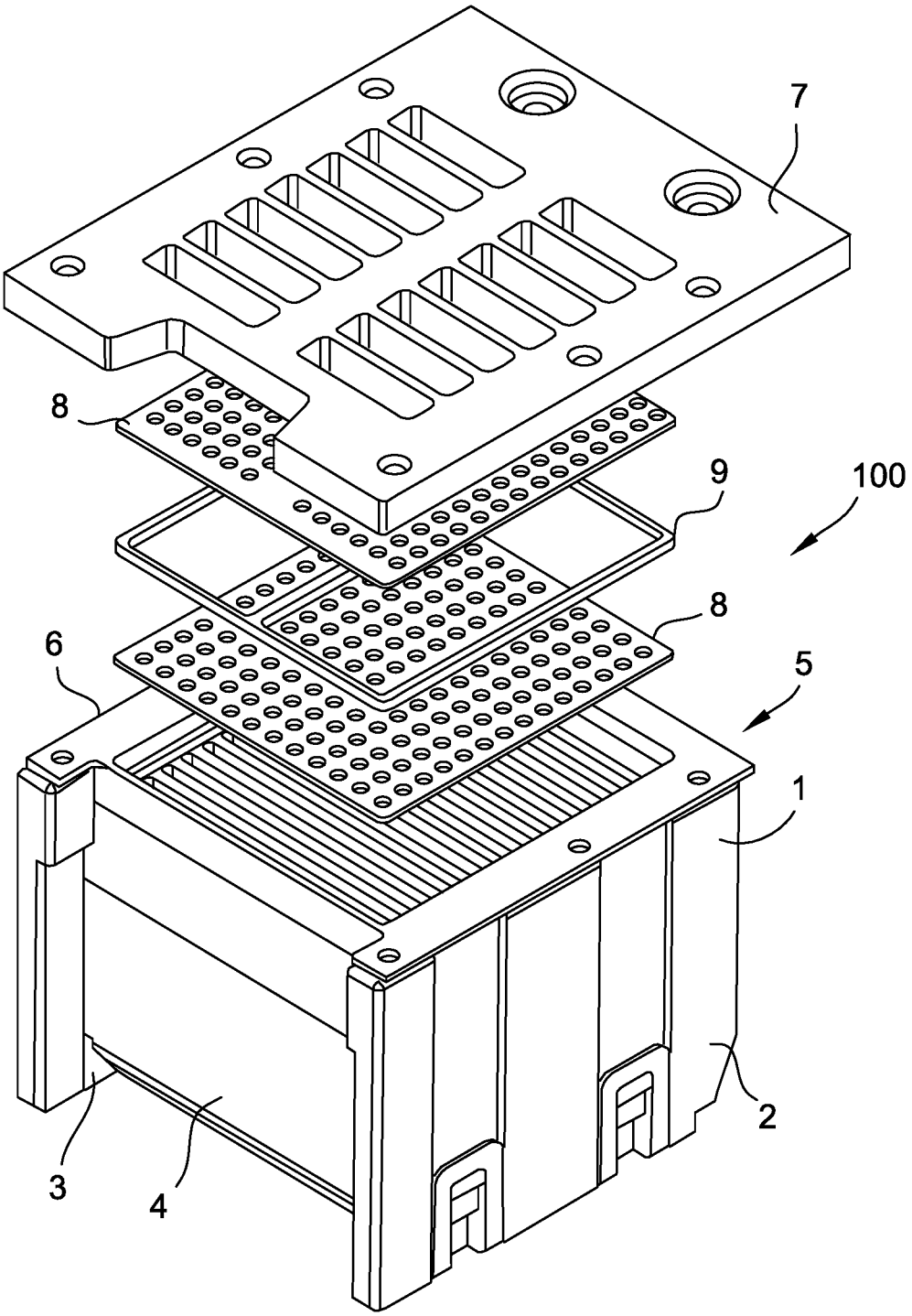
FIG. 1 is a perspective view of a prior art embodiment of an arc chamber for a low-voltage switching device.

With reference to the attached figures, the arc chamber for a low voltage switching device of the present invention comprises an insulating casing 1, having a first and a second lateral walls 2, 3 a rear and a front wall 4, 5.

The casing 1 defines an internal space which houses a number of arc-breaking plates. The set-up of such plates in the arc chamber depend on the kind of switching device and is in general well known and therefore will not be described with further details.

The casing 1 of the arc chamber 10, 20, 30, 40, 50 is provided with which a top wall 6 which has a discharge opening 101 for venting off the gases from said internal space, said discharge opening 101 being in general covered by a top cover 7, 37, 47, 57.

One of the distinguishing features of the arc chamber 10, 20, 30, 40, 50 of the present invention in given by the fact that a filter 11, 21, 31, 41, 51 made of an open cell metal foam is positioned at said discharge opening 101.

As previously explained a filter made of an open cell metal foam is provided with a well-balanced set of mechanical, thermal and flow control properties that make it perfectly suited for the intended scopes.

In this regard, the open cell metal foam of said filter 11, 21, 31, 41, 51 preferably has the following properties:

- a porosity of greater than 70%, preferably greater than 80%, more preferably greater than 85%;
- a thermal conductivity of lower than 15 $W \cdot m^{-1} \cdot K^{-1}$, preferably lower than 12 $W \cdot m^{-1} \cdot K^{-1}$, more preferably lower than 10 $W \cdot m^{-1} \cdot K^{-1}$;
- a tensile strength of greater than 5 MPa, preferably greater than 10 MPa, more preferably greater than 15 MPa.

Moreover, in order to guarantee an increase of the turbulence of the gas flow, the open cell metal foam of said filter 11, 21, 31, 41, 51 is conveniently provided with a structure having randomly distributed channels.

Thus, in general, the filter 11, 21, 31, 41, 51 made of an open cell metal foam is positioned at said discharge opening 101 so as cover entirely said discharge opening 101, thereby fully controlling the discharge of the hot gases from the internal space of the arc chamber 10, 20, 30, 40, 50 to the external ambient.

Figure 2:
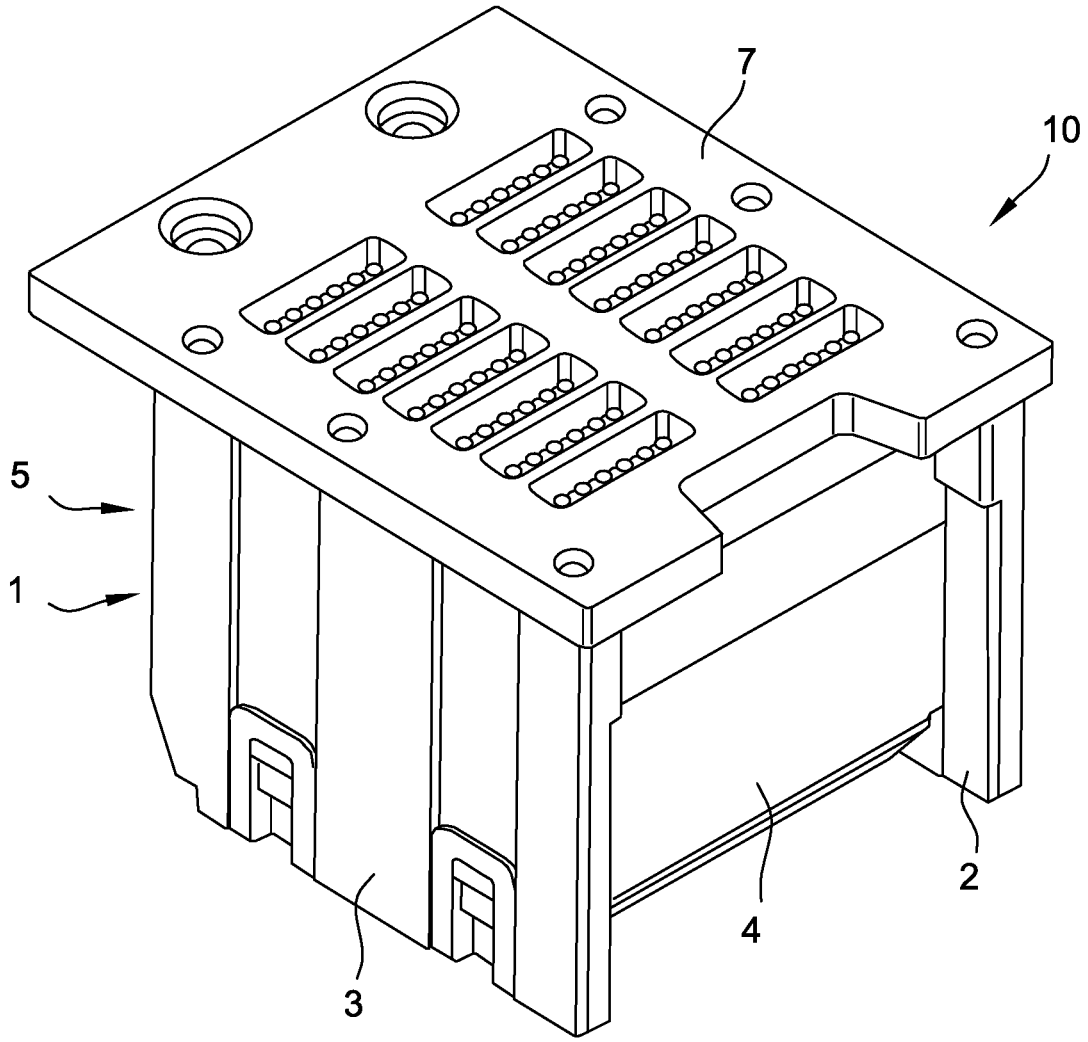
FIG. 2 is a perspective view of a first embodiment of an arc chamber for a low-voltage switching device according to the invention.
Figure 3:
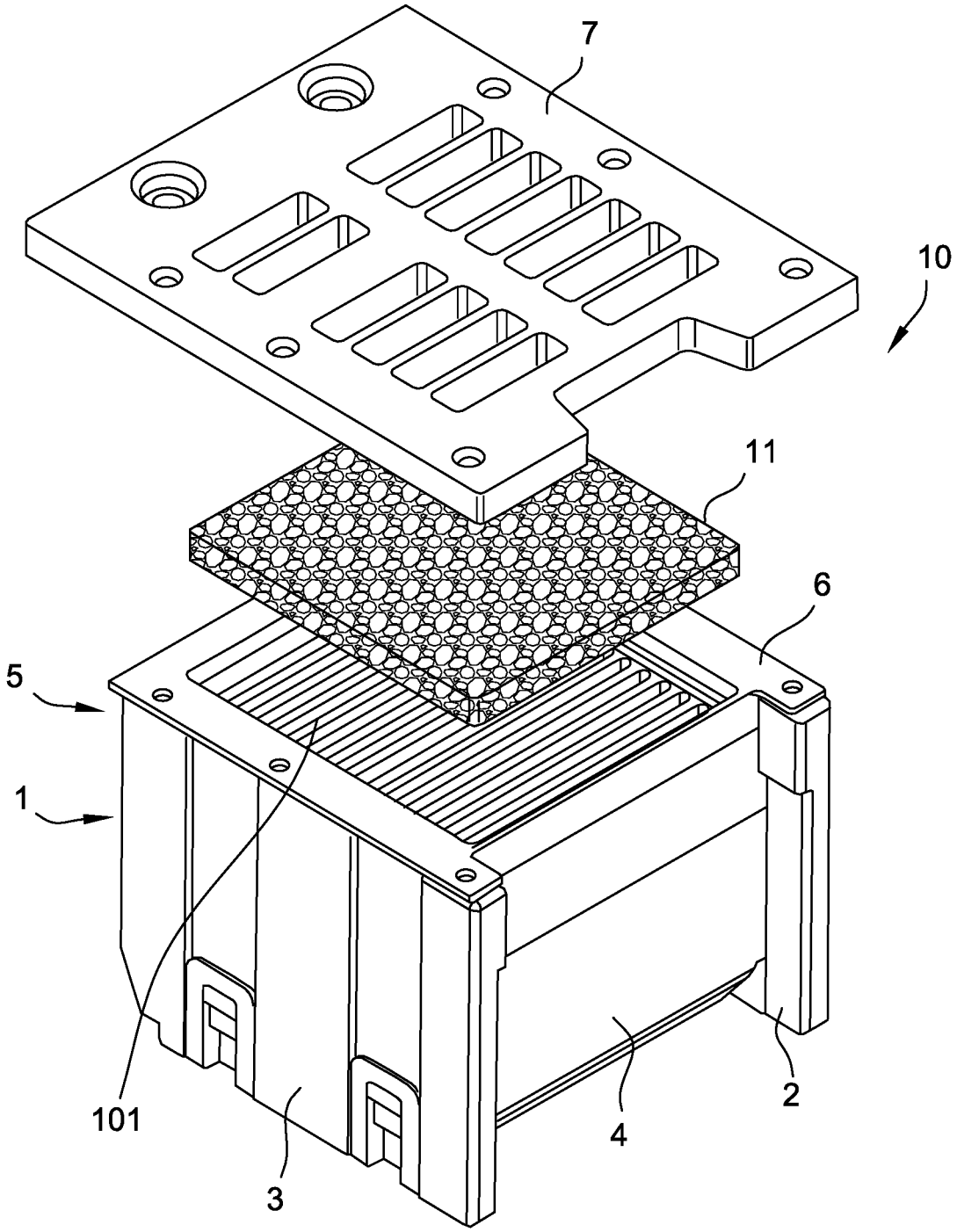
FIG. 3 is an exploded view of a first embodiment of an arc chamber for a low-voltage switching device according to the invention.

With reference to FIGS. 2 and 3, in a first exemplary embodiment of an arc chamber 10 for a low-voltage switching device according to the invention, said filter 11 made of an open cell metal foam is directly interposed between the discharge opening 101 of the casing 1 of the arc chamber 10 and said top cover 7. It is clear, by comparing such embodiment with the prior art embodiment of FIG. 1 that the former is much simpler than the latter, since it is made by one single piece, instead of the at least three pieces of the prior art filter. Moreover, as previously explained the mechanical, thermal and flow control properties of the filter 11 can easily be tailored so as to better match the practical needs with respect to the prior art filters made by a combination of different parts.

Figure 4:
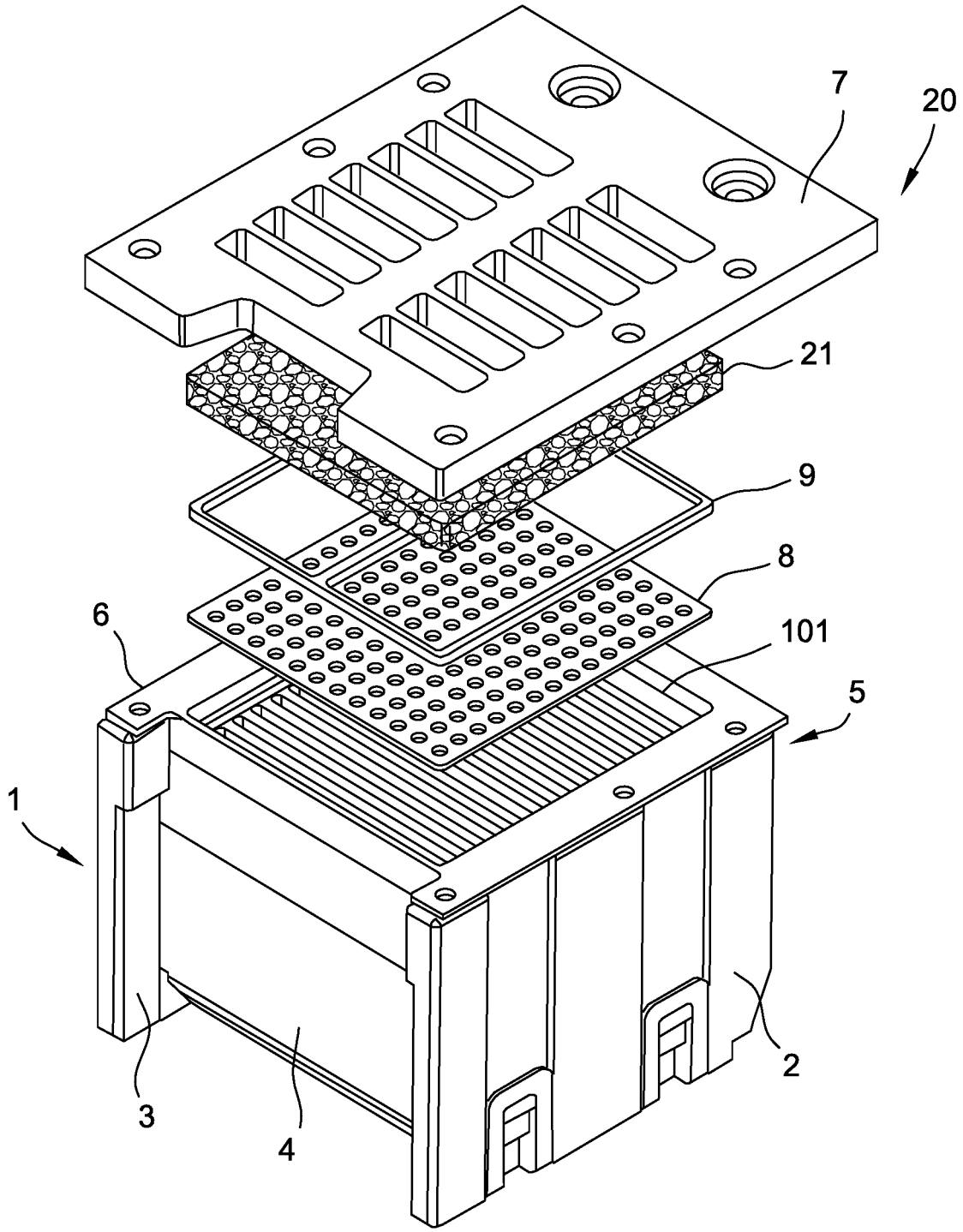
FIG. 4 is an exploded view of a second embodiment of an arc chamber for a low-voltage switching device according to the invention.

However, with reference to FIG. 4 which shows a second exemplary embodiment of an arc chamber 20 for a low-voltage switching device according to the invention, if so desired, a filter 21 made of an open cell metal foam may be combined also with other component parts as in prior art filters.

In such a case, the arc chamber 20 for a low voltage switching device, according to this embodiment, comprises a perforated sheets 8 which is positioned between said filter 21 made of an open cell metal foam and the discharge opening 101 of the casing 1 of the arc chamber 20. A spacer 9 is then interposed between said perforated sheets 8 and said filter 21 made of an open cell metal foam and a top cover 7 is superimposed onto said filter 21 made of an open cell metal foam to complete the assembly.

Figure 5:
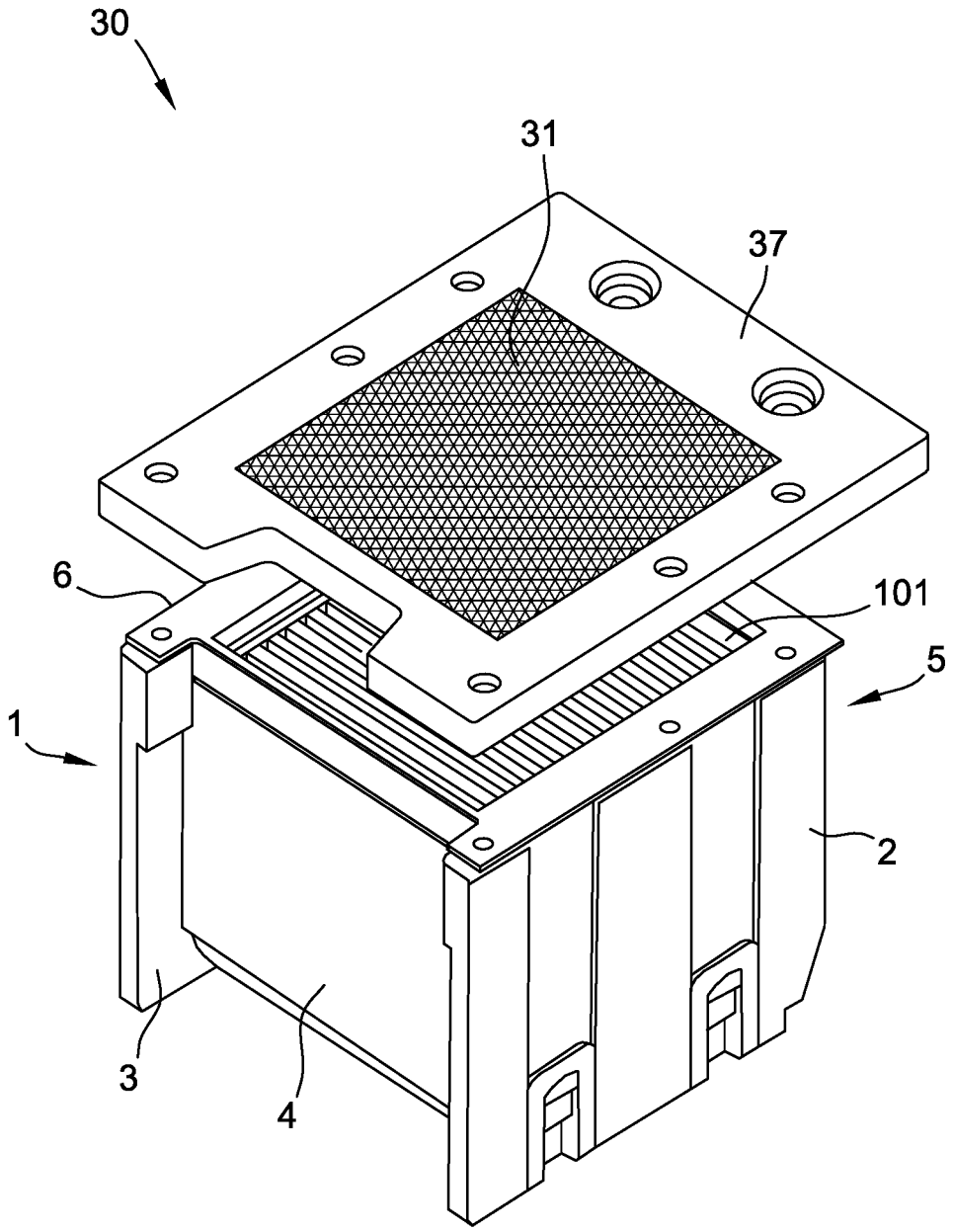
FIG. 5 is an exploded view of a third embodiment of an arc chamber for a low-voltage switching device according to the invention.

With reference to FIG. 5, a much simpler implementation of a filter as herein disclosed is given in a third exemplary embodiment of an arc chamber 30 for a low-voltage switching device according to the invention.

In such embodiment of the arc chamber 30, the filter 31 made of an open cell metal foam is inserted into a top cover 37. In particular, the top cover 37 is provided with a seat that matches the discharge opening 101 of the casing 1 of the arc chamber 30 and the filter 31 is inserted and secured into said seat, thereby realizing an assembly that can be directly fixed on the top wall 6 of the casing 1 of the arc chamber 30. Such solution can be used when the top cover 37 and the filter 31 are made of different materials. The manufacturing and assembly processes are therefore further simplified with respect to the prior art systems.

Figure 6:
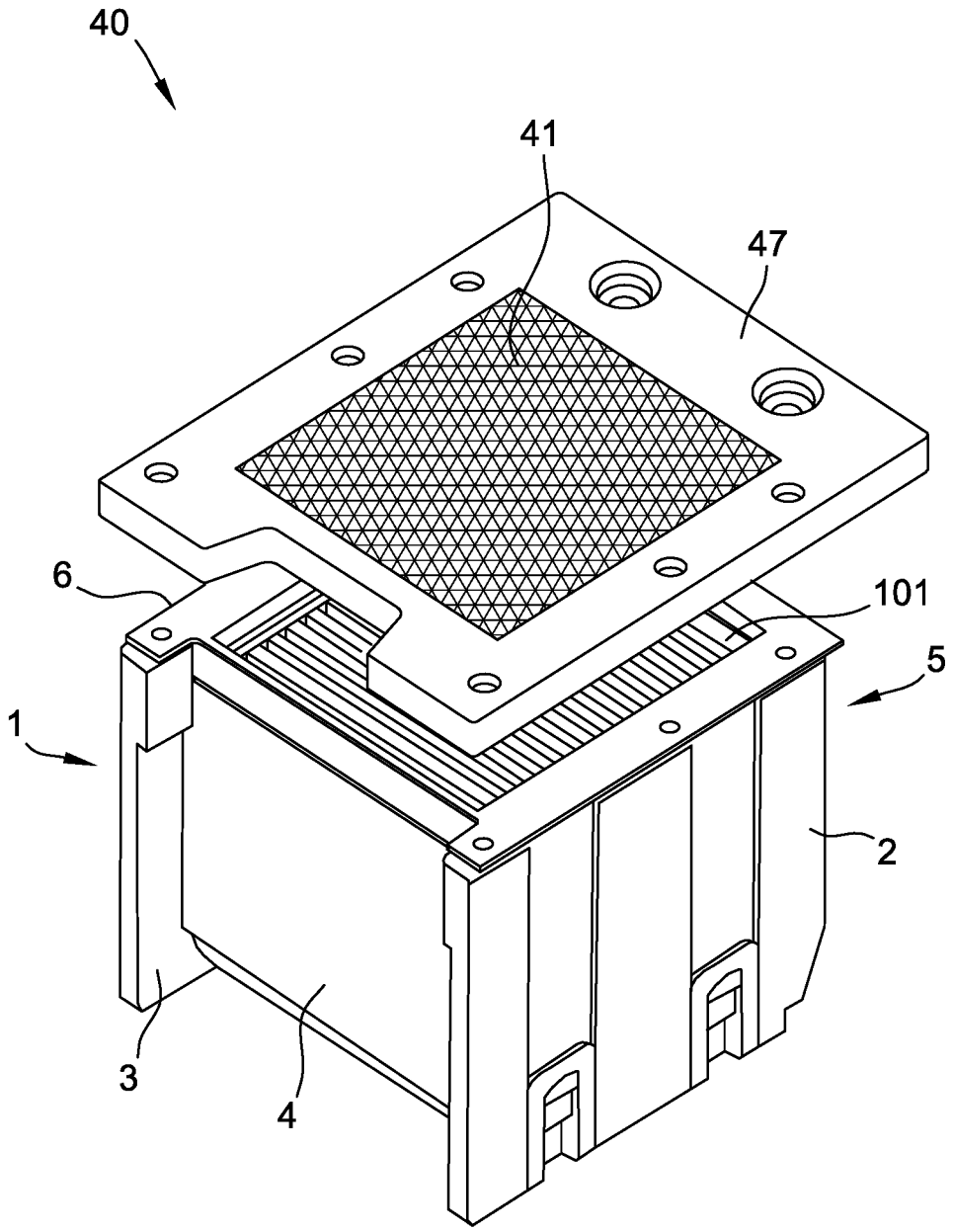
FIG. 6 is an exploded view of a fourth embodiment of an arc chamber for a low-voltage switching device according to the invention.

A further simplified form of implementation of a filter as herein disclosed is given in FIG. 6 which shows a fourth exemplary embodiment of an arc chamber 40 for a low-voltage switching device according to the invention, which is particularly suited when the top cover and the filter are made of the same materials.

In this case, the filter 41 made of an open cell metal foam is integrally made within said top cover 47 thereby realizing a single-piece element that combines the functions of the filter and of the top cover. In practice, the single piece element comprises a frame having the structure of the cover 47 and a core having the structure of the filter 41.

Figure 7:
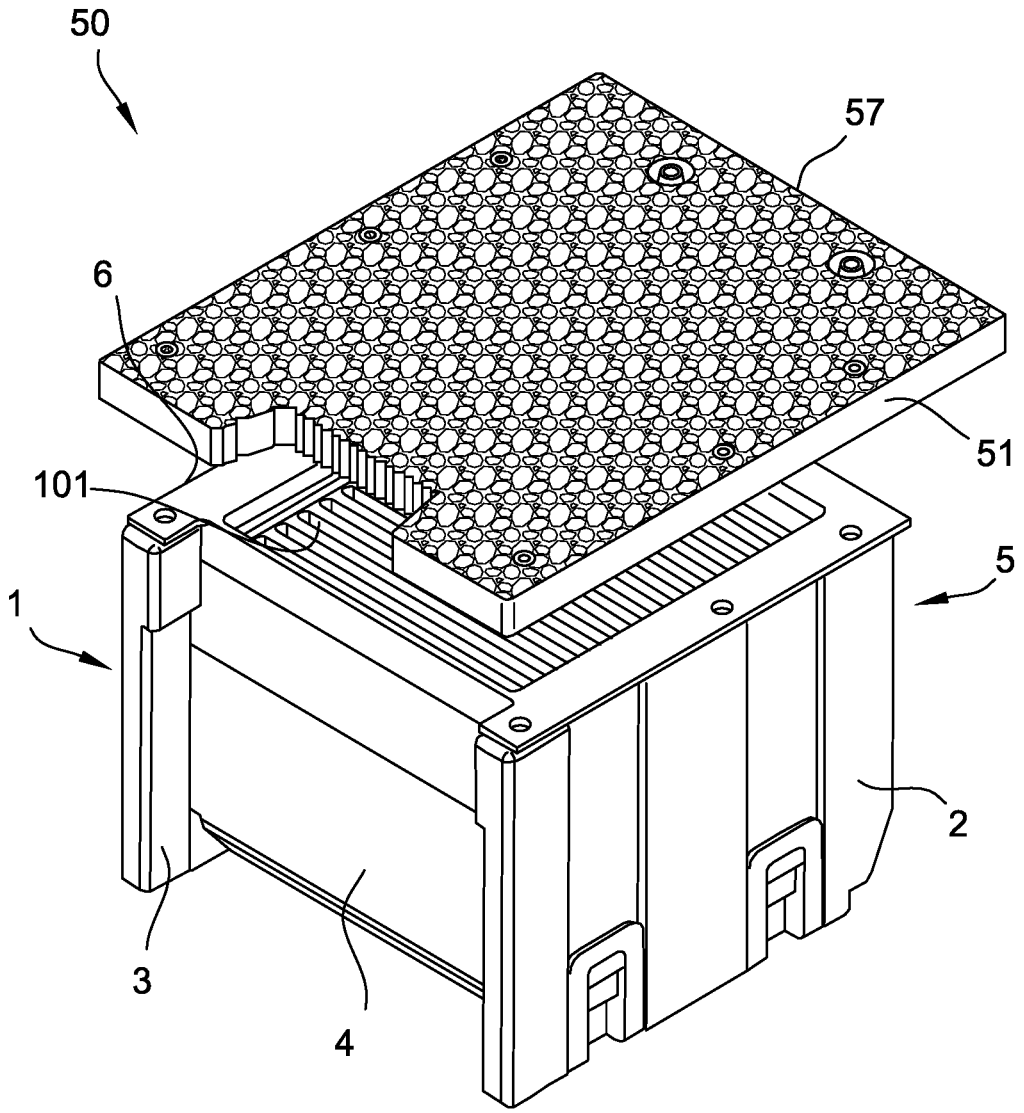
FIG. 7 is an exploded view of a fifth embodiment of an arc chamber for a low-voltage switching device according to the invention.

With reference to FIG. 7, which shows a fifth exemplary embodiment of an arc chamber 50 for a low-voltage switching device according to the invention, a still simplified form of implementation of a filter as herein disclosed can be obtained when said top cover 57 is entirely made with said filter 51 made of said open cell metal foam. In other words, in this embodiment of the arc chamber 50, the top cover 57 and the filter 51 totally coincide, being the one and same thing.

With respect to the other embodiments shown beforehand, this latter has the following advantages, maintaining at the same time the same advantages over the prior art systems:

Improved compactness;

Higher mechanical stability;

Improved assembly easiness;

Further cost reduction.

In a further aspect the present invention also relates to a low voltage switching device, including but not limited to, a circuit breaker, a disconnector, or a contactor, comprises an arc chamber as disclosed herein.

Figure 8:
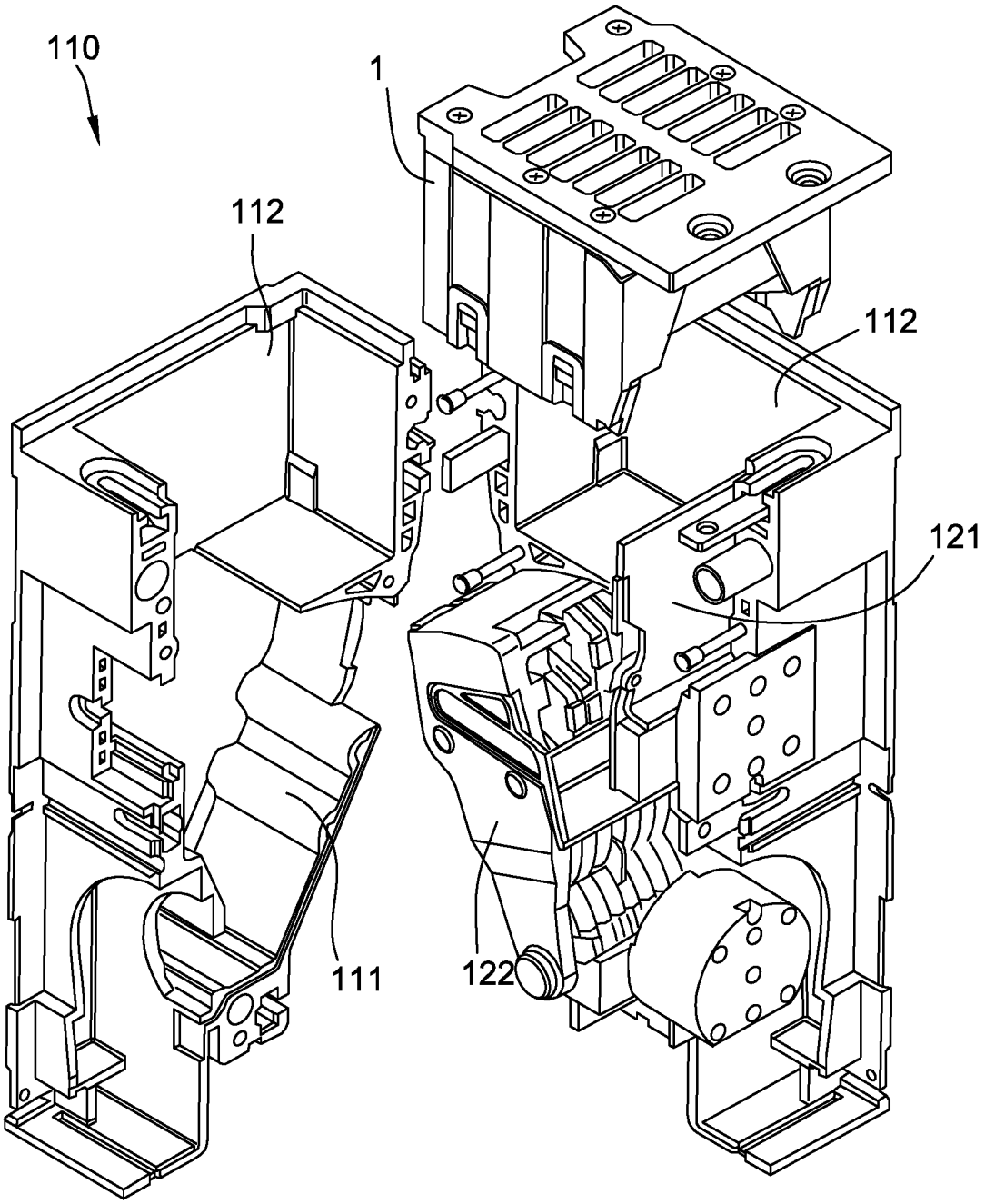
FIG. 8 is an exploded view of a pole of a low voltage power circuit breaker housing an arc chamber according to the invention.
Figure 9:
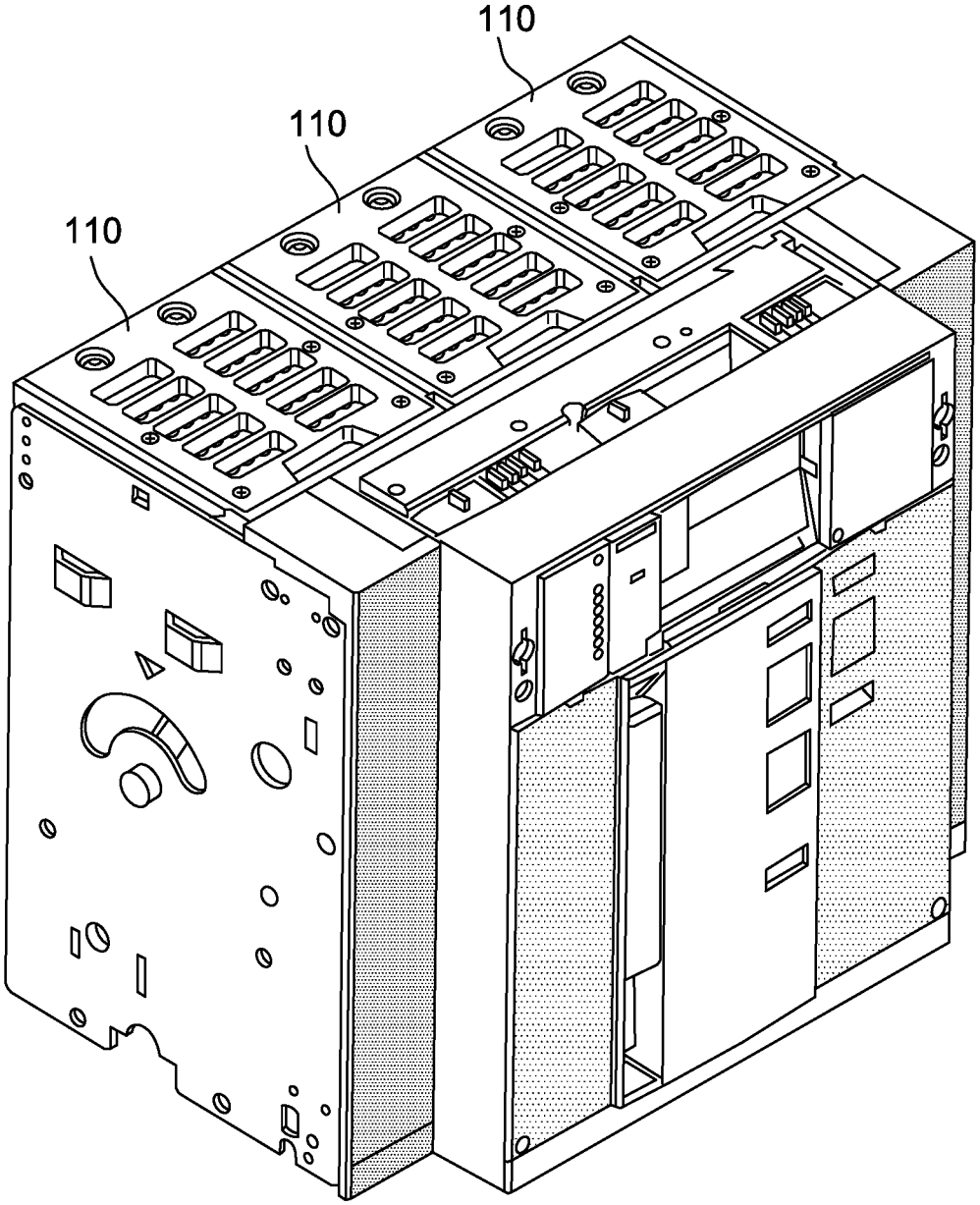
FIG. 9 is a perspective view of a low voltage power circuit breaker housing an arc chamber according to the invention.

In particular, with reference to FIGS. 8 and 9, the presently disclosed arc chambers are particularly suitable for use in low voltage power circuit breakers, such as air insulated circuit breakers or molded case circuit breakers (MCCB), which generally comprise one or more electrical poles 110.

With particular reference to FIG. 8, a typical pole 110 of low voltage power circuit breaker has an internal space delimited by an enclosure which, in the embodiment shown, is made of two half-enclosures coupled to each other.

Within said internal space of the pole 110, there is a contact area 111 and an arc extinguishing area 112, located proximate to said contact area 111. A fixed contact assembly 121 and a movable contact assembly 122 are respectively positioned in said contact area 111, said movable contact assembly 122 being movable between a closed position in which it is into contact with said fixed contact assembly 121 and an open position in which it is spaced apart from said fixed contact assembly 121. The set-up of a pole of circuit breaker of this kind is well known in the art and will not be described with further details.

Inside the internal space of the pole 110 there is also an arc extinguishing area 112 into which an insulating casing 1 of an arc chamber 10, 20, 30, 40, 50 of the present invention can be easily fitted, according to embodiments which are well known in the art.

It is clear from the above description that the low voltage power circuit breaker of the present invention, fully achieve the intended aims and solved the above-highlighted problems of the existing electrical cabinets.

In practice, as previously explained, in the arc chamber of the present invention, the use of a filter made of an open cell metal foam allows to achieve at least the following advantages with respect to the arc chambers of known type:

Temperature decrease of the hot stream;

Flow control;

Acoustic control;

Mechanical thermo-elastic dumping of induced vibrations;

Fire protection;

Increased mechanical stiffness at the discharge section of the breaker.

Several variations can be made to the arc chamber for low voltage switching device thus conceived, all falling within the scope of the attached claims. In practice, the materials used and the contingent dimensions and shapes can be any, according to requirements and to the state of the art.

The invention claimed is:

1. An arc chamber for a low voltage switching device comprising an insulating casing, having a first and a second lateral walls a rear and a front wall, that defines an internal space housing a number of arc-breaking plates, a top wall of said casing having a discharge opening for venting off gases from said internal space, said discharge opening being covered by a top cover, wherein said top cover is entirely made of a filter comprising an open cell metal foam, and wherein said open cell metal foam of said filter has a thermal conductivity of lower than 10 $W \cdot m^{-1} \cdot K^{-1}$ to prevent said filter from melting said insulating casing when venting off said gases from said internal space.

2. The arc chamber for said low voltage switching device, according to claim 1, wherein said filter comprising said open cell metal foam covers entirely said discharge opening.

3. The arc chamber for said low voltage switching device, according to claim 1, wherein said open cell metal foam of said filter has a porosity of greater than 70%.

4. The arc chamber for said low voltage switching device, according to claim 3, wherein said open cell metal foam of said filter has a tensile strength of greater than 5 MPa.

5. The arc chamber for said low voltage switching device, according to claim 4, wherein said open cell metal foam of said filter is provided with a structure having randomly distributed channels.

6. The arc chamber for said low voltage switching device, according to claim 3, wherein said open cell metal foam of said filter is provided with a structure having randomly distributed channels.

7. The arc chamber for said low voltage switching device, according to claim 3, wherein said open cell metal foam of said filter has a tensile strength of greater than 10 MPa.

8. The arc chamber for said low voltage switching device, according to claim 7, wherein said open cell metal foam of said filter has a tensile strength of greater than 15 MPa.

9. A low voltage switching device comprising the arc chamber according to claim 1.

10. The arc chamber for said low voltage switching device, according to claim 1, wherein said open cell metal foam of said filter has a tensile strength of greater than 5 MPa.

11. The arc chamber for said low voltage switching device, according to claim 10, wherein said tensile strength of said open cell metal foam of said filter is greater than 10 MPa.

12. The arc chamber for said low voltage switching device, according to claim 1, wherein said open cell metal foam of said filter is provided with a structure having randomly distributed channels.

13. The arc chamber for said low voltage switching device, according to claim 1, wherein said open cell metal foam of said filter has a porosity of greater than 80%.

14. The arc chamber for said low voltage switching device, according to claim 13, wherein said open cell metal foam of said filter has a tensile strength of greater than 5 MPa.

15. The arc chamber for said low voltage switching device, according to claim 14, wherein said open cell metal foam of said filter has a tensile strength of greater than 10 MPa.

16. The arc chamber for said low voltage switching device, according to claim 15, wherein said open cell metal foam of said filter has a tensile strength of greater than 15 MPa.

17. The arc chamber for said low voltage switching device, according to claim 1, wherein said open cell metal foam of said filter has a porosity of greater than 85%.

18. The arc chamber for said low voltage switching device, according to claim 17, wherein said open cell metal foam of said filter has a tensile strength of greater than 5 MPa.

19. The arc chamber for said low voltage switching device, according to claim 18, wherein said open cell metal foam of said filter has a tensile strength of greater than 10 MPa.

20. The arc chamber for said low voltage switching device, according to claim 19, wherein said open cell metal foam of said filter has a tensile strength of greater than 15 MPa.

* * * * *